United States Patent [19]

Kettler

[11] 4,000,772

[45] Jan. 4, 1977

[54] APPARATUS FOR PRODUCING CASTING MOLDS

[75] Inventor: Erich Kettler, Mettmann, Germany

[73] Assignee: Georg Fischer Aktiengesellschaft, Schaffhausen, Switzerland

[22] Filed: Jan. 30, 1976

[21] Appl. No.: 653,961

[30] Foreign Application Priority Data

Feb. 5, 1975 Switzerland ..... 1476/75

[52] U.S. Cl. ..... 164/194; 164/162; 164/211; 164/244

[51] Int. Cl.[2] ..... B22C 15/02

[58] Field of Search ..... 164/37, 40, 162, 169, 164/193, 194, 211, 244, 187, 192

[56] References Cited

UNITED STATES PATENTS

| | | | |
|---|---|---|---|
| 1,001,887 | 8/1911 | Rothbone | 164/211 |
| 1,807,578 | 5/1931 | McAvoy | 164/40 |
| 2,049,967 | 8/1936 | Luton | 164/194 X |
| 2,155,800 | 4/1939 | Perazo | 164/162 |
| 3,094,749 | 6/1963 | Yearley et al. | 164/37 |
| 3,234,602 | 2/1966 | Hunter et al. | 164/244 X |
| 3,256,571 | 6/1966 | Lund | 164/244 X |
| 3,648,759 | 3/1972 | Lund et al. | 164/192 X |
| 3,901,307 | 8/1975 | Nieman | 164/244 |

FOREIGN PATENTS OR APPLICATIONS

| | | | |
|---|---|---|---|
| 1,177,776 | 9/1964 | Germany | 164/192 |
| 7,875 | 3/1911 | United Kingdom | 164/40 |

*Primary Examiner*—Ronald J. Shore
*Attorney, Agent, or Firm*—Toren, McGeady and Stanger

[57] ABSTRACT

The upper part of a casting mold is produced in apparatus which includes a mold table and a mold presser plate between which the casting mold is compressed. A pattern plate is positioned on the mold table and a feed hopper introduces mold forming material into a mold box arranged on the mold table. The feed hopper includes a premolding member which has a location and dimensions generally corresponding with a sink pattern member located on the presser plate in order to form a depression for a sink in the upper part of the mold. A sprue is formed by means extending between the pattern plate and the sink pattern member which includes a compressible spring which is compressed by the sink pattern member when the mold is compressed between the presser plate and the mold table.

10 Claims, 12 Drawing Figures

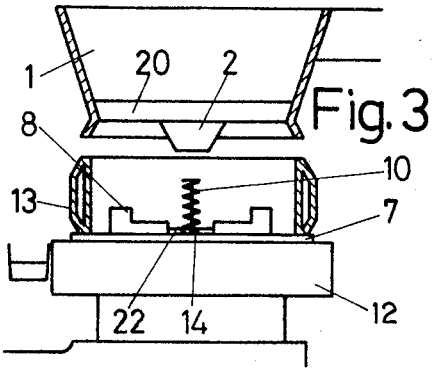
Fig. 3
Fig. 4
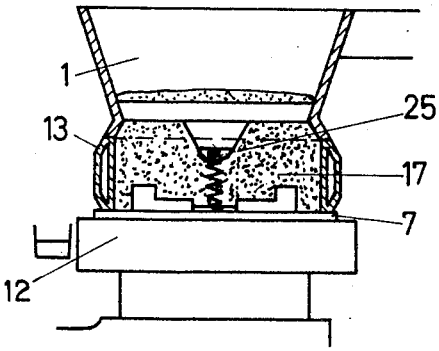
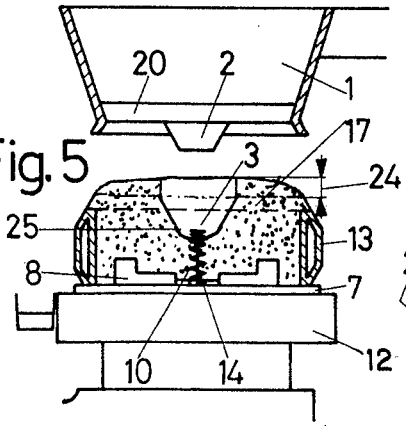
Fig. 5
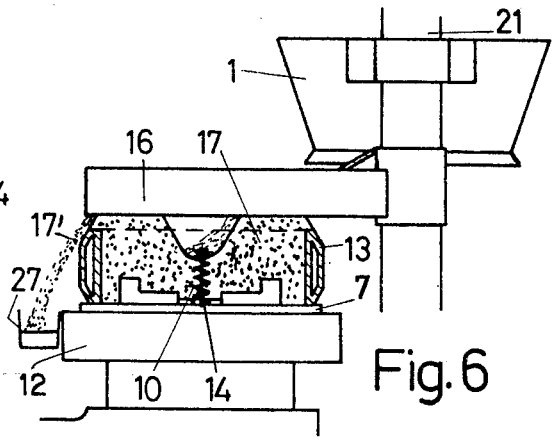
Fig. 6
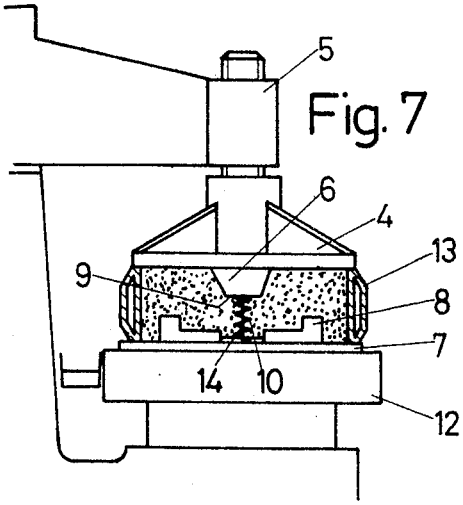
Fig. 7
Fig. 8
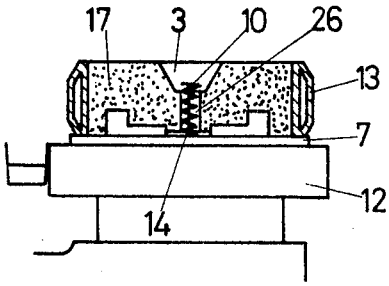

APPARATUS FOR PRODUCING CASTING MOLDS

BACKGROUND OF THE INVENTION

The present invention relates generally to apparatus for producing the upper part of a casting mold and more particularly to equipment which includes a feed hopper for delivering molding compound into a molding box within which the mold is formed. The equipment to which the present invention relates includes a presser board and a mold table between which the molds are compressed with a pattern plate being attached on the mold table and with a sink pattern member being arranged on the presser board for forming a sink in the mold. A sprue pattern member is also provided for forming a sprue in communication between the pattern means on the pattern plate and the sink of the mold.

Various molding devices have been used for forming in a mold feed uppers, casting stumps or sinks on the top of the upper part of the casting mold and also for forming associated sprues and spouts in the casting mold.

In the prior art, for example German Pat. No. 1,051,064, techniques are known for forming such sprue depressions in the mold forming material particularly in connection with fully automatic molding equipment. Examples of this type of prior art technique usually require a milling tool as well as an additional operation thereby giving rise to undesirable effects with regard to station time.

Further known prior art techniques, as disclosed for example in German Pat. No. 744,158, utilize sprue molding devices made of rubber which are attached upon a journal of the pattern plate prior to the commencement of molding operation. Such parts must be removed from the casting mold after it is formed and before it is lifted. In molding plants which are designed for continuous production, this type of sprue formation involves a disadvantageous loss of time and the risk that accidents might occur. Such disadvantages cannot be overlooked.

Additional prior art devices, known for example from German DAS No. 1,083,024, involve a molding body called an upper course pattern which is designed for molding a sink and the respective sprues. Several journals, used partly for molding the sprues and partly as a support for the molding body, are arranged perpendicularly to the molding plane in the upper course pattern. These are inserted in bores and they are susceptible to movement therein in the axial direction. Into such bores there is inserted a compression spring acting on the journals, with the spring being compressed during the final compression of the mold. The spring tends to lift the upper course pattern from the mold by virtue of a certain degree of expansion which occurs and in order to fix the position of the upper course pattern on the pattern plate, pilot bars are arranged on the pattern plate for engagement by the bottom ends of the journals. A specially designed device is used for the attachment of the upper course pattern on the pattern plate before the formation of the mold and for lifting it from the finished casting mold. This additional molding operation involving attachment and lifting of the upper course pattern as well as the maintenance of the required device, produce an adverse effect on the costs of mold production. Additionally, it is found that patterns cannot be arranged at those points of the pattern plate on which the supporting journals bear thereby further limiting the utilization of the pattern plate.

Other molding devices known from the prior art, for example, German DOS No. 2,245,169, involve a molding die for molding sprue recesses arranged on the underside of a presser board of the presser head and attachment on the pattern plate of several column-shaped pattern parts for forming molding sprues. Recesses corresponding to the column-shaped pattern parts are provided in the molding die into which the pattern parts penetrate during the pressing of the molding die into the molding compound. However, molding compound which adheres to the pattern parts is unavoidably pressed into the recesses of the molding die thereby giving rise to a requirement for additional cleaning operations and the likelihood of premature wear of the interlocking parts.

Additionally, as is known from existing molding technology, the molding compound tends to exhibit certain characteristics during its compression. In order to obtain a uniform compression of the molding compound, the pressure which is applied should be uniformly distributed over the entire mold surface. Such a requirement is not met, however, in many prior art techniques since the molding compound tends to be compressed more within the range of the molding die by the height of the latter thereby giving rise to an adverse effect upon the quality of the mold which is produced.

Accordingly, it is an object of the invention to provide a molding device for the production of the upper parts of casting molds which may be used on molding machines having feed hoppers which are swung over the mold table and attached to the mold box for delivering molding compound thereto and which operate in molding plants involving intermittent or continuous operation. The molding device of the invention is also intended for use with existing molding equipment without requiring additional costs with regard to the particular mold box forms which are used, and it is intended as capable of formation by simple means permitting conversion of the casting molds to different casting systems without the requirement of specially skilled operators.

SUMMARY OF THE INVENTION

Briefly, the present invention may be described as apparatus for producing part of a casting mold comprising a mold box, feed hopper means for feeding mold forming material into the mold box, a presser board and a mold table adapted to press the mold forming material therebetween, a pattern plate including pattern means arranged on the mold table, sink pattern means arranged on the presser board for forming a sink in the surface of the mold forming material, at least one premolding member provided on the feed hopper means for forming an initial depression in the casting molds with the premolding member being located and dimensioned in a manner generally corresponding to the sink formed by the sink pattern means on the pattern plate and sprue pattern means extending to form a sprue communicating the sink with the pattern means, the sprue pattern means including spring means which extend substantially perpendicularly to the premolding member and the sink pattern means. The invention is particularly characterized in that at least one premolding member for forming a sink or similar depression is attached on the feed hopper with the position of the premolding member and the dimensions thereof being adapted to the associated sink pattern means which are utilized to form the sink in the finished mold part and which are secured on the presser board. Furthermore, a particular characteristic of the invention resides in the fact that at least one compression spring extending substantially perpendicularly to the underside of the premolding member or the sink pattern means is provided attached on the pattern plate to form a sprue in communication between the sink and the pattern means of the pattern plate.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive material in which there are illustrated and described preferred embodiments of the invention.

DESCRIPTION OF THE DRAWINGS

In the drawings:

FIG. 3 is a sectional view of the apparatus of FIG. 1 showing the feed hopper in position over the mold box;

FIG. 4 is a sectional view showing the device of FIG. 3 with the feed hopper attached to the mold box and with the mold precompressed;

FIG. 5 is a sectional view showing the feed hopper lifted from the mold box;

FIG. 6 is a vertical section showing the molding device during stripping of excess molding compound from the casting mold;

FIG. 7 is a vertical section showing the molding device with the presser board in position during the compression operation;

FIG. 8 shows the finished casting mold before lifting thereof off the molding table;

DETAILED DESCRIPTION OF THE PREFERRED EMBODIMENTS

Figure 1:
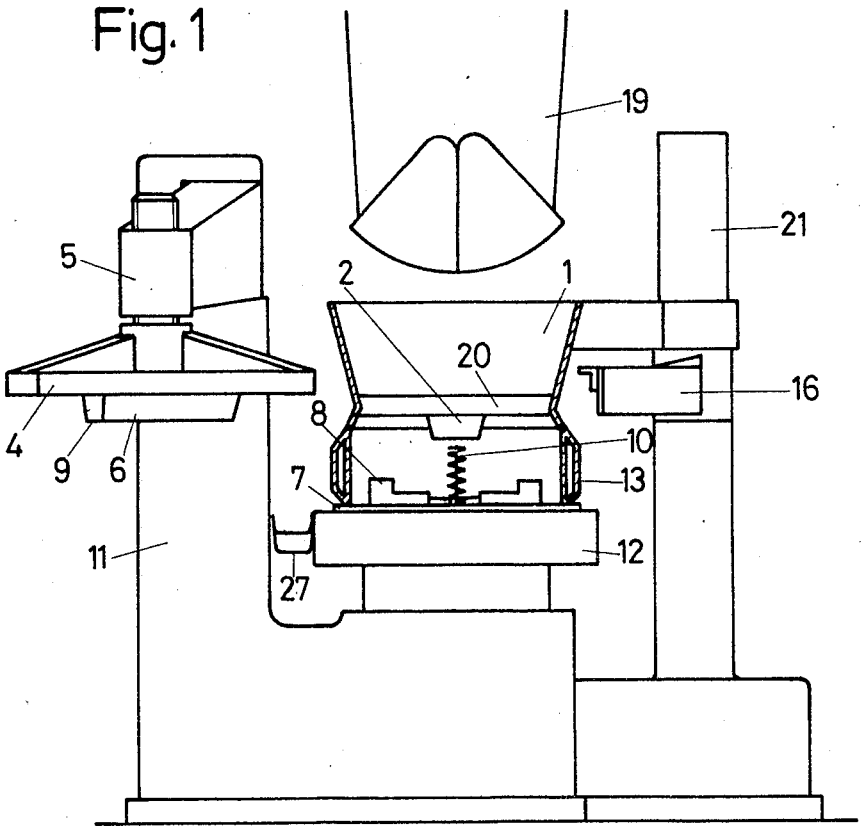
FIG. 1 is a vertical sectional view of a molding machine embodying the device of the present invention.
Figure 2:
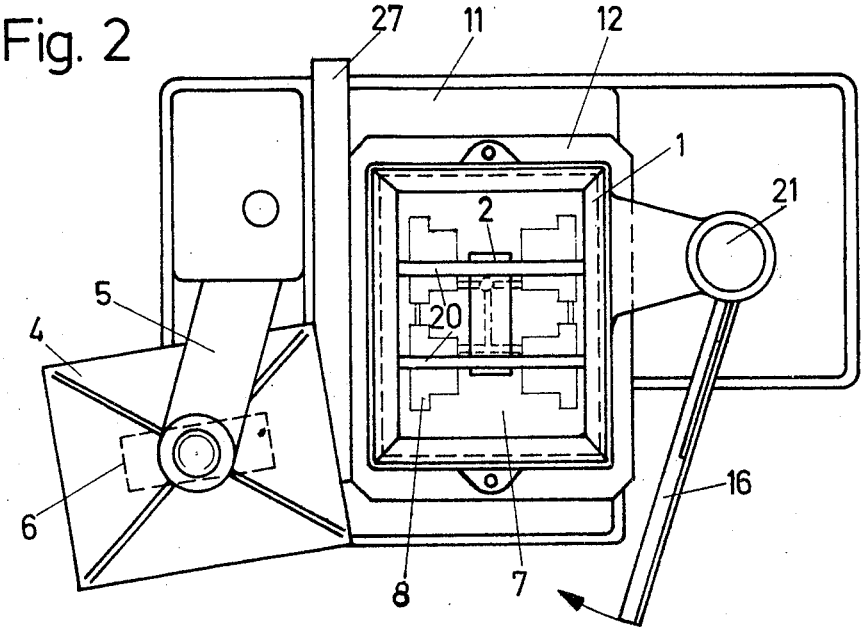
FIG. 2 is a top view of the apparatus of FIG. 1.

Referring now to the drawings, wherein like reference characters refer to similar parts throughout the various figures thereof, there is shown in FIGS. 1 and 2 a molding machine 11 having a mold table 12 upon which there rests a pattern plate 7 equipped with pattern means such as the patterns 8 with a mold box 13 being arranged to extend around the pattern means 8. A feed hopper 1 is arranged to be swung over the mold table and placed upon the mold box 13 by operation of a swivel column 21 which mounts the feed hopper 1 for rotative movement thereabout and for vertical raising and lowering thereof by actuation of a control device (not shown) which is part of the molding machine 11.

The feed hopper 1 includes an outlet opening upon which there is secured a premolding member 2 having dimensions which correspond generally to a sink 3 which is to be molded on the top side of the upper mold part with the dimensions being smaller by a predetermined amount than the sink, the predetermined amount resulting from the molding capacity of the molding compound.

The feed hopper 1 includes holders 20 which are preferably detachably connected with the hopper 1 and the premolding member 2 respectively. Arranged above the hopper 1 and the mold box 13 is a molding sand silo 19 for feeding a dosed amount of the molding sand 17 to the mold box 13. Pivotally mounted on the swivel column 21 is a sand stripper 16 which is actuated by the control device of the molding machine for stripping from the casting mold excess sand applied during the filling operation.

The apparatus includes a presser head 5 having a presser board 4 which is movable by a swinging motion over the mold box 13 by means of the control device of the molding machine 11. Secured on the presser board 4 on the side thereof directed toward the mold box 13 is a sink pattern member 6 operating to form in the mold a sink 3. The sink pattern member 6 is preferably connected with the presser board 4 in a manner enabling detachment thereof thereby permitting the use of the apparatus for different forms of sinks 3.

The premolding member 2 connected to the feed hopper 1 is arranged so that its location and dimensions generally coincide with the location and dimensions of the sink pattern member 6 in order to enable the premolding member 2 to form an initial depression in the mold material which may be subsequently finished by the utilization of the sink pattern member 6.

The mechanism of the invention includes sprue pattern means which include a compression spring 10 detachably mounted on the pattern plate 7 to extend substantially vertically therefrom to the underside of the premolding member 2 or of the sink pattern member 6 in order to enable formation within the mold of a sprue 26. Sprue pattern means are provided for each of the sprues 26 to be formed. Within the space enclosed by the wire spiral of the compression spring 10, which preferably comprises a relatively thin wire of relatively small outside diameter, there is inserted a coaxially extending pilot bar 14 connected with the pattern plate 7 to form a clearance space with the inside diameter of the compression spring 10. The height of the pilot bar 14 is made to substantially correspond with the height of the compression spring 10 extending between the sink pattern member 6 and the pattern plate 7 during pressing of the casting mold. Depending upon the number of pattern means 8 which are arranged upon the pattern plate 7 and the design of the casting system, a corresponding number of compression springs 10 may be used. It is also possible to use compression springs of this type for molding risers or air ducts, such compression springs being arranged outside the sink range directed toward the presser board 4.

Figure 10:
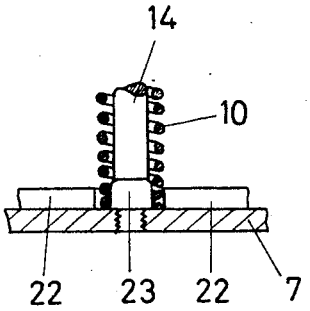
FIG. 10 is a vertical section showing on an enlarged scale sprue pattern means including a compression spring with a fastening journal.

In order to secure the compression spring 10 on the pattern plate 7, the spring is pressed with its end turns on a ring-shaped reinforcement element 23 of the pilot bar 14, as shown in FIG. 10. The element 23 is bolted to the pattern plate 7 so that the spring 10 is connected at the same time with spouts 22 of the casting system. However, it is possible to use different types of fastening means for the compression spring 10. The height of the compression spring 10 including the fastening means is so dimensioned that the relaxed height of the spring is greater than the distance between the pattern plate 7 and the underside of the sink pattern member 6. The compressed height of the device including the compression spring 10 is made to be less than the distance between the pattern plate 7 and the underside 9 of the sink pattern member 6.

The compression spring 10 is designed as a generally cylindrical spring having a circular wire cross section with the outside diameter being selected to correspond to the desired cross section of the sprue 26. However, instead of cylindrical compression springs 10, other types of springs, for example those having a polygonal cross section or a cross section differing from a circular wire form, may be readily used.

Figure 11:
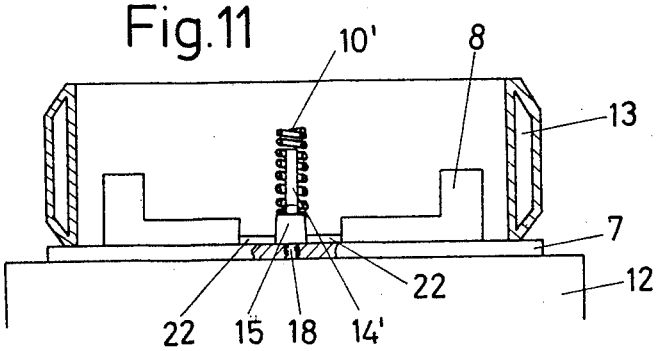
FIG. 11 is a vertical section showing the arrangement of a compression spring with a pilot bar on the pattern plate.

In order to permit usage of standard compression springs which have the required height for a certain height of the casting mold, a pilot bar 14′ with a collar 15 may be used, as shown in FIG. 11. The pilot bar 14′ is provided at the point of transition with the collar 15 with an annular reinforcement upon which a compression spring 10′ is pressed with its end turns. The collar 15 is preferably conical, widening toward the direction of the pattern plate, and is provided with a threaded pin 18 for connection with the pattern plate 7. Thus, the collar 15 is brought into connection at the same time with at least one spout 22 of the casting system. The diameter of the collar 15 corresponds at least to the outside diameter of the compression spring 10′. The height of part of the pilot bar 14′ penetrating into the compression spring 10′ and guiding the spring is substantially adapted to the compressed height of the compression spring 10′ during the compression operation. The total height of the pilot bar 14′ including the height of the collar 15, taking into account a safety distance between the end of the pilot bar 14′ and the underside 9 of the sink pattern member 6, is adapted to the distance between the underside 9 of the sink pattern member 6 and the pattern plate 7 formed during the compression. The safety distance depends on the molding compound resting on the pilot bar 14′ during molding operation. In order to maintain this distance within narrow limits, the end of the pilot bar 14′ may have the form of a truncated cone.

The various stages of operation of the device during the mold forming process are represented in FIGS. 3–8, and the method of operation will be described in more detail hereinafter.

FIG. 3 depicts the mold table 12 with the attached pattern plate 7 and the mold box 13 with the feed hopper 1 being arranged for swinging movement over the mold box. On the pattern plate 7 there is detachably mounted by means of a pilot bar 14 a compression spring 10 in a position corresponding to the position of the sink 3 to be molded and brought into connection with the patterns 8 over spouts 22 adjoining the compression spring 10. In the hopper 1 there is detachably mounted the premolding member 2 held in place by holders 20 in the outlet opening of the hopper 1 in a position corresponding to the position of sink 3 which is to be formed and also arranged above the compression spring 10. The position of the premolding member 2 in the outlet opening of the hopper 1 is determined in a vertical direction to a great extent by the depth of the finished, compressed sink 3.

FIG. 4 shows a feed hopper 1 lowered on to the molding box 13 with the molding compound of molding sand filled in in dosed amounts into the mold box 13 with the precompressed casting mold in the process of formation. During the precompression of the molding compound 17, a "filling shadow" is formed on the underside of the premolding member 2. That is, a predetermined cavity is developed between the underside of the premolding member 2 and the molding compound 17 located therebeneath.

FIG. 5 shows the precompressed casting mold with the hopper 1 and the premolding member 2 in the lifted position. The compression spring will protrude into the premolded sink 3 with its upper end turns. The number of these end turns is determined to a great extent by the total contraction of the spring and the depth of the finished, compressed sink 3. In the state of the mold represented, the upper side of the casting mold is provided with excess molding sand 24 formed during filling of the mold box 13. The excess molding sand is stripped off to a predetermined height above the mold box by means of a sand stripper 16, as shown in FIG. 6. During the stripping of the excess molding sand 24, the depression in the premolded sink 3, forming part of the cavity 25 depicted in FIG. 4, is covered with loose molding compound 17 and the excess molding compound 17′ stripped off above the mold edge is caused to overflow into an overflow trough 27. By covering this depression, a premolded sink will be formed which is adapted to the surface of the stripped mold so that a uniform compression of the casting mold can be achieved during the following final compression operation.

FIG. 7 shows the finished, compressed casting mold with attached presser board 4 and finish forming sink pattern member 6. During the compression operation, the compression spring 10 is compressed by the finishing sink pattern member 6 by a distance equivalent to the distance of the compression path and it is thus placed under a compressive force. Simultaneously with lifting of the presser board 4 and of the sink pattern member 6 from the casting mold, the compression spring 10 will move to a relaxed position with a substantially rectilinear movement. Thus, the spring 10 will pierce through the molding compound 17 and the spring turns will exert at the same time a scraping action on the molding compound 17 whereby the compression spring 10 is exposed, as shown in FIG. 8. Thus, a sprue 26 or the like is formed after the lifting of the casting mold.

After the casting mold has been lifted from the pattern plate 7, the pattern plate is blasted clean and, if necessary, sprayed with a parting compound with the sand remaining in the compression springs 10 being removed at the same time.

Figure 9:
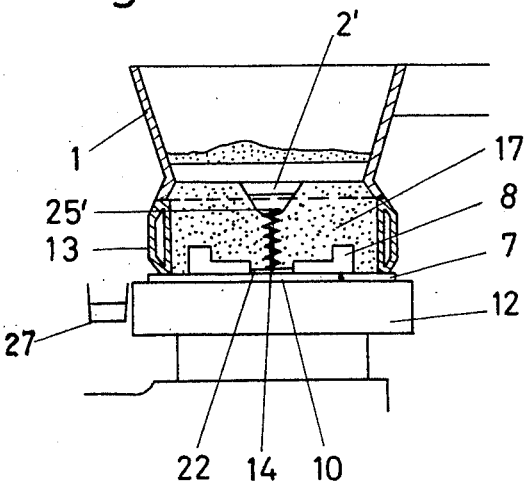
FIG. 9 is a vertical sectional view showing a molding device having a plate-shaped premolding part.

FIG. 9 shows a molding device in accordance with the present invention wherein a plate-shaped premolding member 2′ is provided as a local filling block for the molding compound 17 whose width and length are smaller than the dimensions of the finished sink. In this manner the formation of a cavity 25′ formed by the filling shadow can be insured which is relatively greater than the cavity 25 formed in the premolding member 2 as seen in FIG. 4. It is thus possible to obtain, for example, sinks with offset sink bottoms or similar special designs by the utilization of such simple means. The premolding member may have in its longitudinal direction a wedge form or a form corresponding to the desired end form of the sink.

Figure 12:
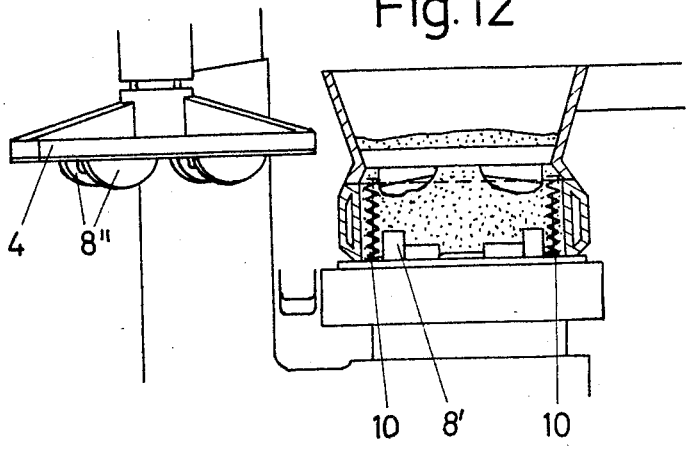
FIG. 12 is a vertical section showing a variation of the invention for casting mold halves to be molded on both sides.

Similarly designed devices may also be provided, as shown in FIG. 12, for mold halves to be molded on both sides. For example, in stack casting, where mold cavity halves for castings are formed instead of the sink and where compression springs 10 are used for molding the vertical spouts and risers, such devices may find application. On the presser board 4 there are detachably mounted the respective mold halves 8'' associated with the mold halves 8' attached on the pattern plate 7.

The advantages achieved with the present invention are particularly directed toward provision of a safe and versatile molding device which is obtained with a few relatively simple parts. Since the premolding member must only meet relatively moderate demands, low material costs may be expected thereby producing a generally favorable effect on the overall production costs of the device. This device permits optimum utilization of the casting mold and the molded sink may have any desired volume. Thus there is permitted feeding of large amounts of melt per unit of time of the casting mold without any risk. Long term tests have shown that casting molds produced with the present device exhibit a homogeneous compression of the molding compound. It has also been found that the compression springs showed moderate signs of wear and worked satisfactorily.

While specific embodiments of the invention have been shown and described in detail to illustrate the application of the inventive principles, it will be understood that the invention may be embodied otherwise without departing from such principles.

What is claimed is:

1. Apparatus for the production of the upper part of a casting mold comprising: a mold box; feed hopper means for feeding mold forming material into said mold box; a presser board and a mold table adapted to press said mold forming material therebetween; a pattern plate including pattern means arranged on said mold table; sink pattern means arranged on said presser board for forming a sink in the surface of said mold forming material; at least one premolding member provided on said feed hopper means for forming a depression in said casting mold having a location and dimensions generally corresponding to said sink formed by said sink pattern means on said pattern plate; and sprue pattern means extending to form a sprue communicating said sink with said pattern means, said sprue pattern means including spring means extending substantially perpendicularly to said premolding member and said sink pattern means.

2. Apparatus according to claim 1 including fastening means for fastening said spring means to said pattern plate, wherein said spring means comprise a compression spring having a compressed height when in a compressed position and a relaxed height when in an uncompressed position, and wherein said relaxed height of said compression spring including said fastening means is greater than the distance between said pattern plate and said sink pattern means with said compressed height being no more than the equivalent of said distance.

3. Apparatus according to claim 2 wherein said compression spring is detachably connected with said pattern plate.

4. Apparatus according to claim 2 further including a pilot bar detachably mounted to the pattern plate for guiding said compression spring through movement to its compression height.

5. Apparatus according to claim 2 wherein said pilot bar includes a collar which bears against said compression spring, the diameter of said collar corresponding at least to the outside diameter of said compression spring.

6. Apparatus according to claim 1 wherein said sink pattern means is detachably connected with said feed hopper means.

7. Apparatus according to claim 1 wherein said premolding member is dimensioned to be smaller than said sink pattern means.

8. Apparatus according to claim 1 comprising a plurality of premolding members and a plurality of sink pattern means provided for molding mold cavity halves for casting mold parts, with a plurality of spring means being provided on said pattern plate for forming in said casting molds a plurality of vertically extending cavities.

9. Apparatus according to claim 1 wherein said feed hopper means are mounted to be movable over said mold box with said presser board being mounted for movement over said mold box after said feed hopper means have been moved therefrom.

10. Apparatus according to claim 9 wherein said sink pattern means are located on said presser board to extend into said depression formed by said premolding member when said presser board is placed over said mold box after removal therefrom of said feed hopper means.

* * * * *